US006788326B2

(12) United States Patent
Sasaki

(10) Patent No.: US 6,788,326 B2
(45) Date of Patent: Sep. 7, 2004

(54) THERMAL PRINTER USING RECORDING PAPERS DIFFERENT WIDTH-SIZES

(75) Inventor: Hidemi Sasaki, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/400,543

(22) Filed: Apr. 1, 2003

(65) Prior Publication Data

US 2003/0184640 A1 Oct. 2, 2003

(30) Foreign Application Priority Data

Apr. 1, 2002 (JP) ..... 2002-099089

(51) Int. Cl.[7] ..... B41J 25/312
(52) U.S. Cl. ..... 347/198
(58) Field of Search ..... 347/197, 198; 400/120.16, 120.17

(56) References Cited

U.S. PATENT DOCUMENTS 5,612,727 A * 3/1997 Morimoto et al. ..... 347/198

FOREIGN PATENT DOCUMENTS

| | | | | |
|---|---|---|---|---|
| JP | 63-091260 | * | 4/1986 | ..... B41J/25/28 |
| JP | 03-101996 | * | 4/1991 | ..... B41J/25/304 |
| JP | 08-034146 | * | 2/1993 | ..... B41J/25/312 |
| JP | 8-282061 | | 10/1996 | |
| JP | 09-216393 | * | 8/1997 | ..... B41J/25/312 |
| JP | 10-129075 | * | 5/1998 | ..... B41J/25/312 |
| JP | 10-181148 | * | 7/1998 | ..... B41J/25/312 |
| JP | 2000-000984 | * | 1/2000 | ..... B41J/25/312 |
| JP | 2000-85164 | | 3/2000 | |
| JP | 2002-067429 | * | 3/2002 | ..... B41J/25/312 |
| JP | 2003-211776 | * | 7/2003 | ..... B41J/25/304 |

* cited by examiner

*Primary Examiner*—Huan Tran
(74) *Attorney, Agent, or Firm*—Sughrue Mion, PLLC

(57) ABSTRACT

A thermal head is swingably supported by a shaft. Arm members are swingably attached to the shaft. The arm member presses a head base of the thermal head via a pressure spring. Above the arm members, cam disks are rotatably arranged. The cam disk presses the arm member toward the thermal head. When printing is performed on a color thermosensitive recording paper having a narrow width, the inside cam disks press the arm members to press the thermal head against the recording paper. When printing is performed on another recording paper having a broad width, all the cam disks press the arm members to press the thermal head against the recording paper.

15 Claims, 5 Drawing Sheets

THERMAL PRINTER USING RECORDING PAPERS DIFFERENT WIDTH-SIZES

BACKGROUND OF THE INVENTION

1. Field of the Invention

The present invention relates to a thermal printer, and particularly to a thermal printer using recording papers of different width-sizes.

2. Description of the Related Art

There is a color thermal printer in which a color thermosensitive recording paper is advanced, and during advancement thereof, a thermal head is pressed against the recording paper to print a full-color image by activating a heating-element array. The thermal head is pressed against the recording paper in order to properly apply the heat of the heating-element array to the recording paper. If a pressure force for pressing the thermal head is weak, the heat of the heating-element array is hard to transfer to the recording paper. Due to this, are caused defective prints in which a coloring density is paler than a desired density and a coloring area of a single pixel becomes small, for instance. Meanwhile, if the pressure force for pressing the thermal head is too strong, defective conveyance of the recording paper is caused.

The pressure force of the thermal head for the recording paper is determined in accordance with a width-size of the recording paper. For example, the pressure force of 0.05 Kg is applied to the recording paper per 1 mm thereof in a width direction. In a case that printing is performed on the recording paper having a width of 89 mm, it is necessary to press the thermal head against the recording paper with the pressure force of 4.45 Kg. In another case that printing is performed on the recording paper having a width of 102 mm, it is necessary to press the thermal head against the recording paper with the pressure force of 5.10 Kg.

Some of the color thermal printers can perform the printing on the color thermosensitive recording papers having different width-sizes. In the conventional color thermal printers, however, the pressure force of the thermal head is not changed after the width-size of the recording paper has changed. Thus, there arise problems in that defective prints and defective conveyance of the recording paper are caused.

SUMMARY OF THE INVENTION

In view of the foregoing, it is a primary object of the present invention to provide a thermal printer in which a thermal head is pressed against recording papers of different width-sizes with an appropriate force and at an appropriate position.

It is a second object of the present invention to provide a thermal printer in which defective prints and defective conveyance of a recording paper are prevented from occurring.

In order to achieve the above and other objects, the thermal printer according to the present invention comprises a head pressing mechanism by which a pressure force for pressing the thermal head against the recording paper is changed in accordance with a width of the used recording paper. Incidentally, pressure positions for pressing the thermal head may be also changed together with the pressure force by utilizing the head pressing mechanism.

In the thermal printer according to the present invention, it is possible to press the thermal head against the recording paper with the suitable pressure force and the suitable pressure positions in accordance with the width-size of the recording paper. Thus, printing and conveyance of the recording paper may be properly performed notwithstanding the change of the width-size of the recording paper to be used.

BRIEF DESCRIPTION OF THE DRAWINGS

The above objects and advantages of the present invention will become apparent from the following detailed description of the preferred embodiments of the invention when read in conjunction with the accompanying drawings, in which.

DETAILED DESCRIPTION OF THE PREFERRED EMBODIMENT(S)

Figure 1:
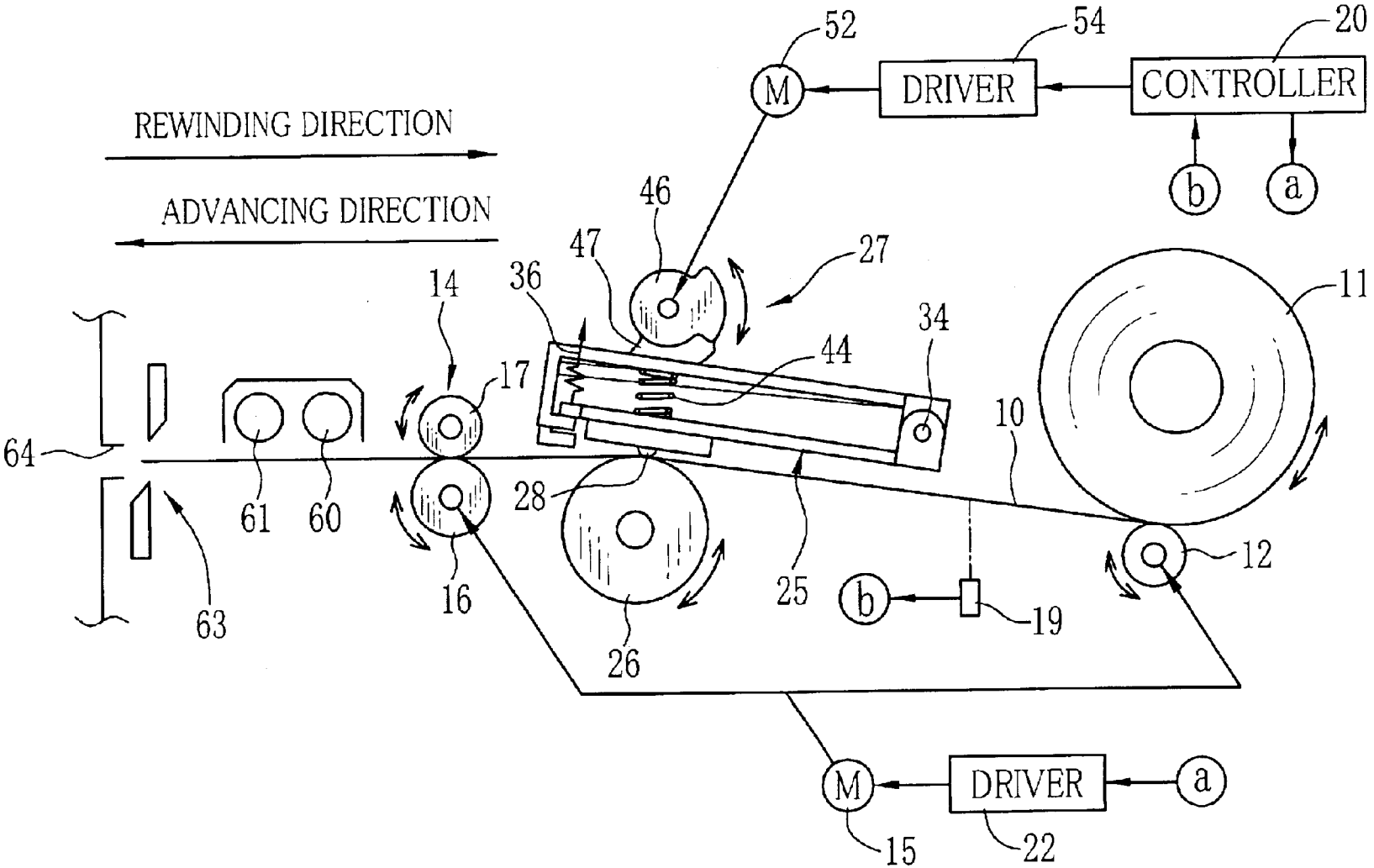
FIG. 1 is a schematic illustration showing a structure of a color thermal printer according to the present invention.

FIG. 1 is a schematic illustration showing a structure of a color thermal printer according to the present invention. The color thermal printer uses a strip of a color thermosensitive recoding paper 10 as a recording medium. The color thermosensitive recording paper 10 is set to the color thermal printer in a state of a recording-paper roll 11, which is wound in a roll form such that a recording surface thereof faces inside. The recoding-paper roll 11 is rotated by a supply roller 12 abutting on a periphery of the recording-paper roll 11 to advance and rewind the recording paper 10.

As well known, the color thermosensitive recording paper 10 includes a cyan thermosensitive coloring layer, a magenta thermosensitive coloring layer, and a yellow thermosensitive coloring layer, which are stacked on a base in order. The yellow thermosensitive coloring layer being as the uppermost layer has the highest thermal sensitivity so as to color in yellow with small thermal energy. The cyan thermosensitive coloring layer being as the lowermost layer has the lowest thermal sensitivity so as to color in cyan with great thermal energy. Incidentally, the yellow thermosensitive coloring layer loses coloring ability when near ultraviolet rays of 420 nm are applied thereto. The magenta thermosensitive coloring layer being as the second layer colors in magenta with thermal energy intermediately ranked between those of the yellow and cyan thermosensitive coloring layers. The magenta thermosensitive coloring layer loses coloring ability when ultraviolet rays of 365 nm are applied thereto.

At a downstream side of the recording-paper roll 11 in an advancing direction of the recording paper, is disposed a feed roller pair 14 for conveying the recording paper 10 in a nipping state. The feed roller pair 14 comprises a capstan roller 16 and a pinch roller 17. The capstan roller 16 is rotated by a motor 15, and the pinch roller 17 is pressed against the capstan roller 16. The recording paper 10 is reciprocated in the advancing direction and a rewinding direction. In the drawing, the advancing direction is a leftward direction and the rewinding direction is a rightward direction. The motor 15 drives the supply roller 12 as well.

The color thermal printer can perform printing for plural kinds of the recording papers having different width-sizes of 89 mm and 102 mm, for instance. At the downstream side of the recording-paper roll 11 in the advancing direction, a photosensor 19 for detecting the width of the advanced recording paper 10 is disposed under a conveyance passage of the recording paper 10. A detection signal of the photosensor 19 is inputted into a controller 20, which controls the whole of the color thermal printer.

The controller 20 comprises a computer, a memory storing an operation program, and so forth. The controller 20 also controls the motor 15 via a driver 22, in addition to the photosensor 19.

A thermal head 25, a platen roller 26 and a herd-pressing mechanism 27 are disposed between the recording-paper roll 11 and the feed roller pair 14. The head-pressing mechanism 27 presses the thermal head 25 against the platen roller 26. The bottom of the thermal head 25 is provided with a heating-element array 28. The thermal head 25 colors the respective coloring layers by activating the heating-element array 28, pressing the heating-element array 28 against the recording paper 10. The platen roller 26 is disposed under the conveyance passage so as to confront the heating-element array 28. The platen roller 26 supports the recording paper 10 and is rotated in association with the conveyance of the recording paper 10.

Figure 2:
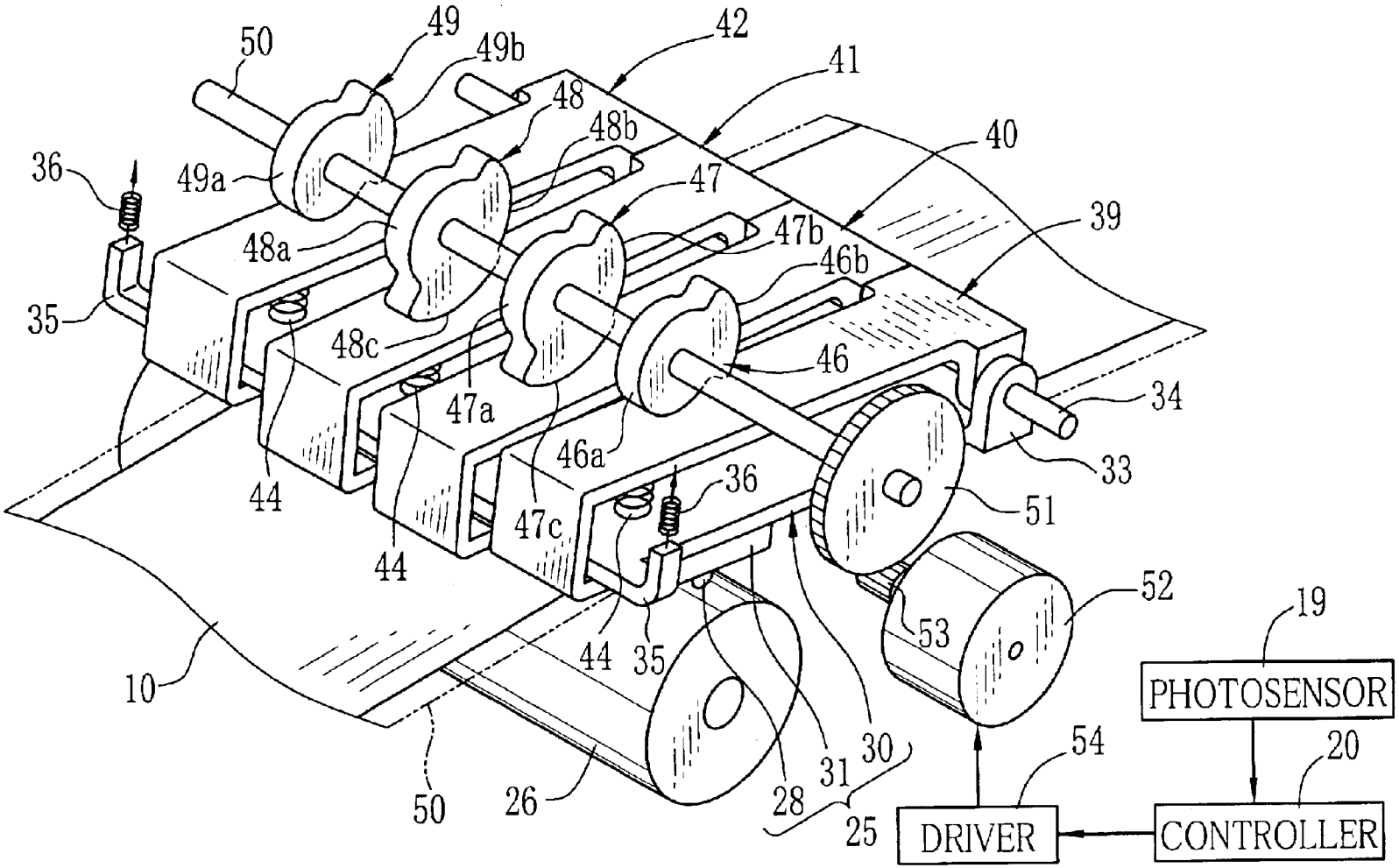
FIG. 2 is a perspective view showing a structure of a thermal head and a head pressing mechanism.

As shown in FIG. 2, the thermal head 25 comprises a head base 30, an alumina plate 31 and the heating-element array 28. The head base 30 is made from a material of aluminium and so forth having high heat conductivity. The alumina plate 31 is attached to the bottom of the head base 30. The heating-element array 28 is provided on the bottom of the alumina plate 31.

A rear end of the head base 30 is formed with a pair of bearings 33. A shaft 34 fixed to the inside of the color thermal printer passes through the bearings 33 so that the thermal head 25 is swingably supported. A front side of the head base 30 is provided with a pair of projections 35 having an L-like shape. A positioning spring 36 is attached to the top of the projection 35. The positioning spring 36 urges the thermal head 25 in a clockwise direction in the drawing.

Between the bearings 33, four arm members 39 to 42 constituting the head-pressing mechanism 27 are swingably attached to the shaft 34 by utilizing bearings of the respective arm members 39 to 42. A top portion of each arm member is bent in a U-like shape and is positioned under the top of the head base 30. Between each of the respective arm members 39 to 42 and the head base 30, is interposed a pressure spring 44 for urging the head base 30 relative to the arm members 39 to 42 in a counterclockwise direction in the drawing. Urging force of the pressure spring 44 is adjusted so as to be stronger than that of the positioning spring 36. Thus, the pressure spring 44 is not displaced by the urging force of the positioning spring 36.

Above the respective arm members 39 to 42, cam disks 46 to 49 for pressing and rotating the arm members 39 to 42 are rotatably supported by a rotary shaft 50. A gear 51 is attached to an end of the rotary shaft 50. The gear 51 meshes with a drive gear 53 attached to the cam motor 52. This cam motor 52 is a stepping motor and is controlled by the controller 20 via a driver 54.

The cam disks 46 and 49 associated with the outside arm members 39 and 42 have a shape different from that of the cam disks 47 and 48 associated with the inside arm members 40 and 41. The outside cam disks 46 and 49 comprise smaller-diameter portions 46*a* and 49*a* where a radius from a rotational center is smaller. The outside cam disks 46 and 49 further comprise medium-diameter portions 46*b* and 49*b* where a radius thereof is larger than that of the smaller-diameter portions 46*a* and 49*a*. The inside cam disks 47 and 48 comprise smaller-diameter portions 47*a*, 48*a* and medium-diameter portions 47*b*, 48*b* having the same radiuses with the cam disks 46 and 49. The inside cam disks 47 and 48 further comprise larger-diameter portions 47*c* and 48*c* where a radius thereof is larger than that of the medium-diameter portions 47*b* and 48*b*. The cam disks 46 to 49 are arranged so as to coordinate the positions of the smaller-diameter portions and the medium-diameter portions in a rotational direction.

Figure 3A:
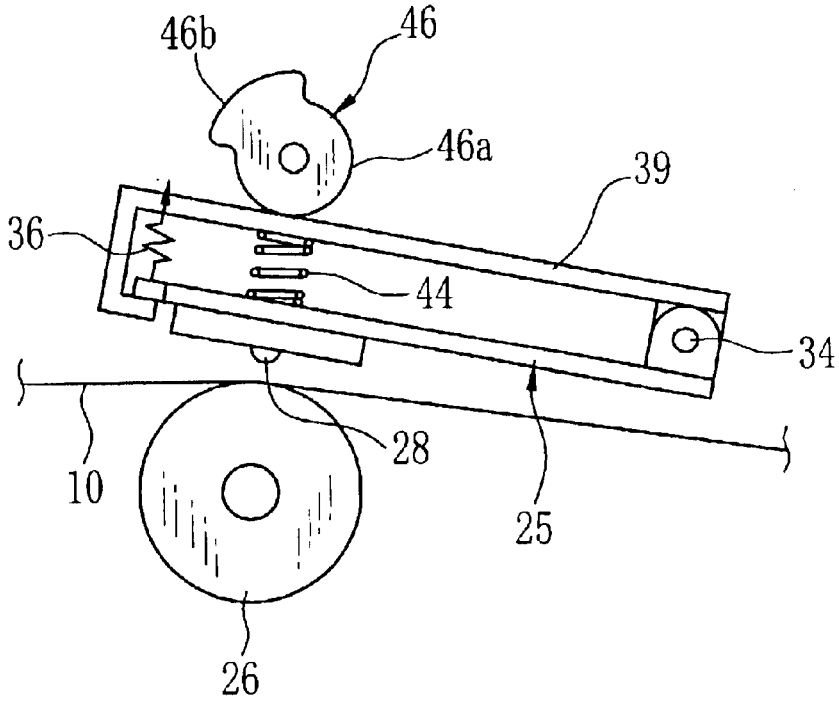
FIGS. 3A and 3B are explanatory illustrations showing waiting states of the thermal head and the head pressing mechanism.
Figure 3B:
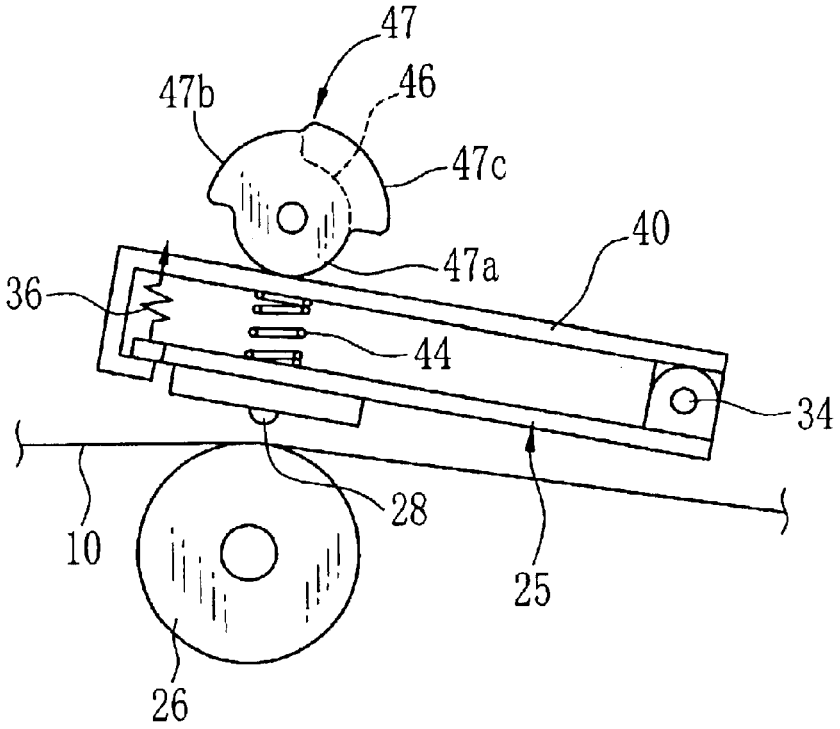

FIGS. 3A and 3B are schematic illustrations showing states of the thermal head 25 in that the color thermal printer is in a waiting condition. As shown in FIGS. 3A and 3B, both the smaller-diameter portions 46*a* and 47*a* of the cam disks 46 and 47 abut on the arm members 39 and 40 respectively. The thermal head 25 is rotated in the clockwise direction by means of the positioning spring 36 so that a gap is formed between the thermal head 25 and the platen roller 26. Incidentally, the arm member 42 and the cam disk 49 are in the same state with the arm member 39 and the cam disk 46. Moreover, the arm member 41 and the cam disk 48 are in the same state with the arm member 40 and the cam disk 47.

Figure 4A:
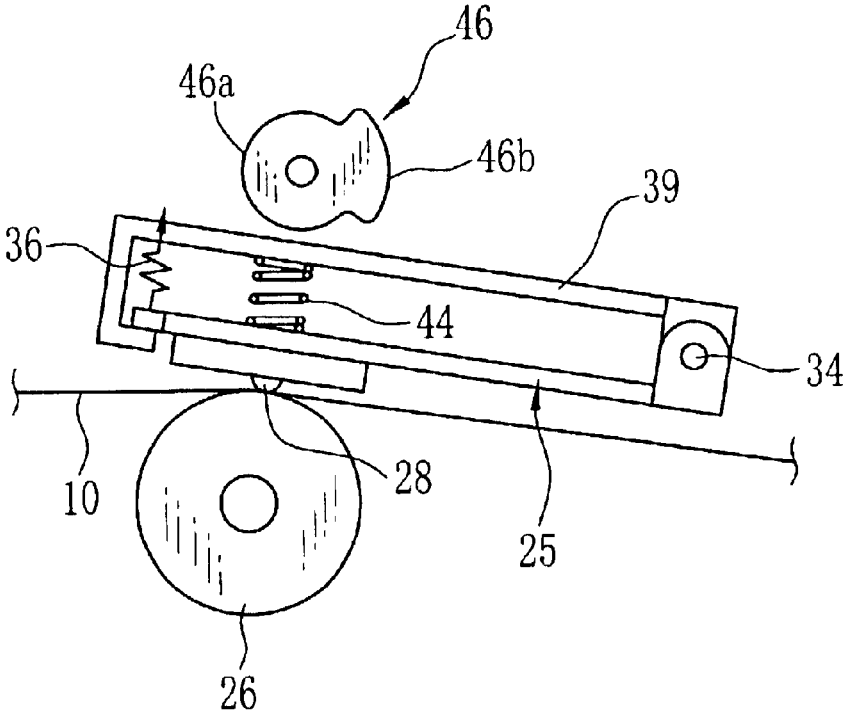
FIGS. 4A and 4B are explanatory illustrations showing printing states of the thermal head and the head pressing mechanism in that printing is performed on a recording paper having a narrow width.
Figure 4B:
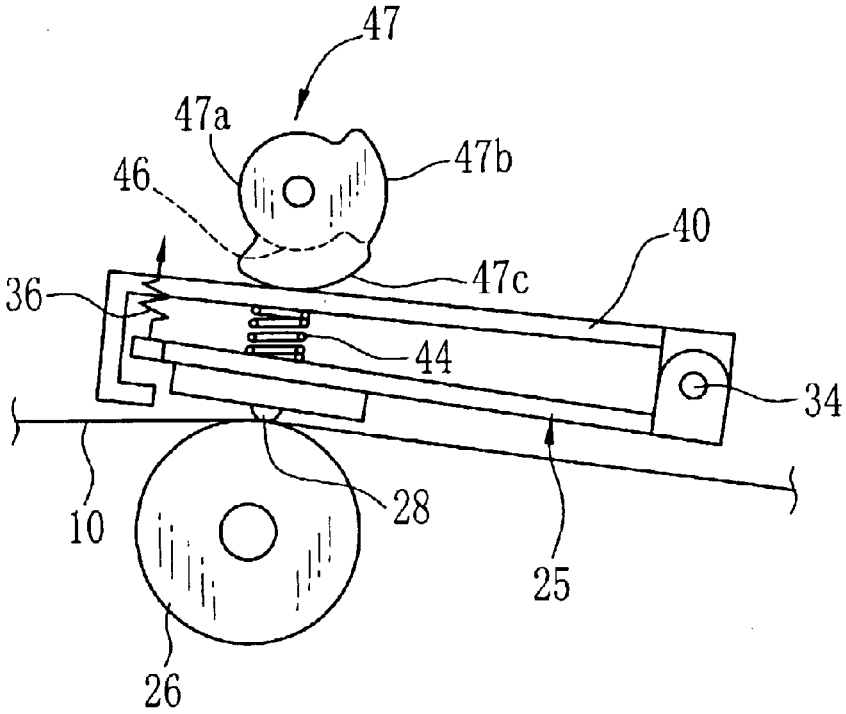

FIGS. 4A and 4B are schematic illustrations showing states of the thermal head 25 in that printing is performed on the recording paper 10 having the width-size of 89 mm. As shown in FIG. 4B, the larger-diameter portion 47*c* of the cam disk 47 abuts on the arm member 40. At this time, as shown in FIG. 4A, the smaller-diameter portion 46*a* of the cam disk 46 avoids confronting and contacting the arm member 39. Incidentally, the arm member 42 and the cam disk 49 are in the same state with the arm member 39 and the cam disk 46. Moreover, the arm member 41 and the cam disk 48 are in the same state with the arm member 40 and the cam disk 47.

In the case that the printing is performed on the recording paper having the narrow width, the thermal head 25 is pressed only by the inside arm members 40 and 41. When performing the printing on the recording paper 10 having the width of 89 mm, the thermal head 25 should be pressed against the recording paper 10 with a pressure force of 4.45 Kg. Thus, each of the arm members 40 and 41 generates a pressure force of 4.45/2=2.225 Kg.

Figure 5A:
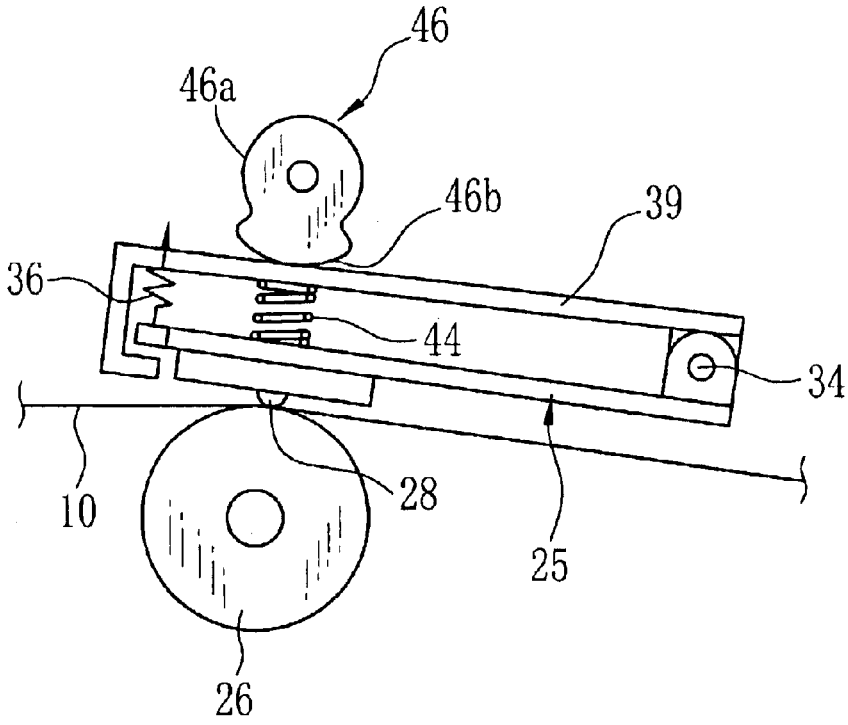
FIGS. 5A and 5B are explanatory illustrations showing printing states of the thermal head and the head pressing mechanism in that printing is performed on a recording paper having a broad width.
Figure 5B:
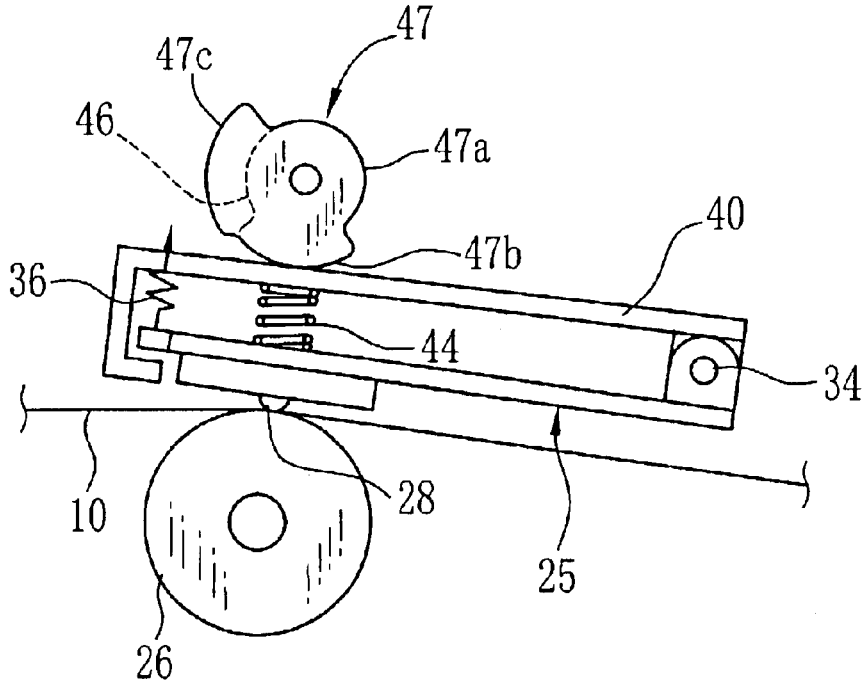

FIGS. 5A and 5B are schematic illustrations showing states of the thermal head 25 in that printing is performed on the recording paper 10 having the width-size of 102 mm. As shown in FIGS. 5A and 5B, both the medium-diameter portions 46*b* and 47*b* of the cam disks 46 and 47 abut on the arm members 39 and 40 respectively. Incidentally, the arm member 42 and the cam disk 49 are in the same state with the arm member 39 and the cam disk 46. Moreover, the arm member 41 and the cam disk 48 are in the same state with the arm member 40 and the cam disk 47.

When performing the printing on the recording paper 10 having the width of 102 mm, the thermal head 25 should be pressed against the recording paper 10 with a pressure force of 5.10 Kg. Thus, each of the arm members 39 to 42 generates a pressure force of 5.10/4=1.275 Kg.

In this way, the pressure force of the thermal head 25 is changed in accordance with the width of the used recording paper so that printing and advancement of the recording paper are properly performed in accordance with the width thereof. Further, pressure positions are also changed in accordance with the width of the recording paper. Thus, the thermal head 25 is pressed against the recording paper with the uniform pressure force even if the thermal head 25 has low rigidity.

At a downstream side of the feed roller pair 14 in the advancing direction, are disposed a yellow fixing lamp 60 and a magenta fixing lamp 61. The yellow fixing lamp 60 radiates the near ultraviolet rays, a luminous peak of which is 420 nm, to fix the yellow thermosensitive coloring layer of the recording paper 10. The magenta fixing lamp 61 radiates the ultraviolet rays of 365 nm to fix the magenta thermosensitive coloring layer.

At a downstream side of the magenta fixing lamp 61 in the advancing direction, a cutter 63 is provided for cutting the strip of the recording paper 10 every recording area. A paper outlet 64 for discharging the recording paper 10 cut in a sheet shape is formed at a downstream side of the cutter 63 and in the front of the color thermal printer.

An operation of the above embodiment is described below. When the color thermal printer is in the waiting condition, the smaller-diameter portions 46*a* to 49*a* of the cam disks 46 to 49 abut on the arm members 39 to 42 respectively, such as shown in FIG. 3. Thus, the thermal head 25 is urged by the positioning spring 36 and is rotated to an evacuation position separated from the platen roller 26 so that the gap is formed between the thermal head 25 and the platen roller 26.

When the color thermal printer is operated to start printing, the controller 20 controls the motor 15 to start the rotation thereof. Owing to this, the supply roller 12 and the feed roller pair 14 start to rotate, and the recoding paper 10 is drawn out of the recording-paper roll 11 to start the conveyance in the advancing direction.

The width-size of the recording paper 10 drawn out of the recording-paper roll 11 is detected by the photosensor 19. And then, the width-size detected by the photosensor 19 is inputted into the controller 20. Incidentally, the current recording paper 10 is the narrow-width recording paper having the width-size of 89 mm.

When a leading edge of the recording area of the recording paper 10 approaches the thermal head 25, the advancement of the recording paper 10 is temporarily stopped. The controller 20 drives the cam motor 52 to rotate the cam disks 46 to 49 in the clockwise direction in the drawing. Since the width-size of the used recording paper 10 is 89 mm, the controller 20 makes the larger-diameter portions 47*c* and 48*c* of the cam disks 47 and 48 abut on the arm members 40 and 41 respectively.

The arm members 40 and 41 pressed by the cam disks 47 and 48 press the head base 30 of the thermal head 25 via the pressure springs 44. Owing to this, the thermal head 25 is moved to a thermal-recording position and is pressed against the recording paper 10 with the pressure force of 4.45 Kg, which is suitable for the recording paper having the width of 89 mm.

After moving the thermal head 25 to the thermal-recording position, the conveyance of the recording paper 10 is resumed by the feed roller pair 14 in the advancing direction. Successively, the heating-element array 28 activates the respective heating elements in accordance with print data to perform the printing on the yellow thermosensitive coloring layer of the recording paper 10.

Upon completing the printing on the yellow thermosensitive coloring layer of the recording area, the conveyance of the recording paper 10 is temporarily stopped. The controller 20 rotates the cam disks 46 to 49 in the counterclockwise direction in the drawing so that the smaller-diameter portions 46*a* to 49*a* abut on the arm members 39 to 42 respectively.

While the thermal head 25 is set to the evacuation position, the supply roller 12 and the feed roller pair 14 convey the recording paper 10 in the rewinding direction. On this occasion, the yellow fixing lamp 60 is turned on to fix the yellow thermosensitive coloring layer of the recording area.

When the leading edge of the recording area of the recording paper 10 approaches the thermal head 25, the conveyance of the recording paper 10 is stopped and the thermal head 25 is moved to the thermal-recording position by the head-pressing mechanism 27. Movement to the thermal-recording position is carried out by the inside cam disks 47, 48 and the arm members 40, 41. The thermal head 25 is pressed against the recording paper 10 with the pressure force of 4.45 Kg.

The recording paper 10 is conveyed by the feed roller pair 14 in the advancing direction to print a magenta image on the magenta thermosensitive coloring layer. After printing the magenta image, the thermal head 25 is moved to the evacuation position. After that, the magenta thermosensitive coloring layer is fixed by the magenta fixing lamp 61, conveying the recording paper 10 in the rewinding direction.

Upon completing the fixation of the magenta thermosensitive coloring layer, the thermal head 25 is moved to the thermal-recording position again and the recording paper 10 is conveyed in the advancing direction. At the same time, printing of a cyan image is started on the cyan thermosensitive coloring layer. After the cyan image has been printed, the recording paper 10 is discharged through the paper outlet 64 to the outside of the printer. And then, the recording paper 10 is cut by the cutter 63 to produce a color print of a sheet form.

In the meantime, when the photosensor 19 detects the recording paper 10 having the width of 102 mm, the controller 20 rotates the cam disks 46 to 49 such that the medium-diameter portions 46*b* to 49*b* abut on the arm members 39 to 42 respectively. In virtue of this, the thermal head 25 presses the recording paper 10 with the pressure force of 5.01 Kg, which is suitable for the recording paper having the width of 102 mm, to properly perform thermal recording.

In the above embodiment, the pressure force is changed in accordance with the recording papers of 89 mm and 102 mm. However, it is possible to change the pressure force in accordance with the recording papers of the other width-sizes.

The pressure force of the thermal head may be changed in accordance with thickness of the recording papers, kinds of the recording papers, humidity and so forth. Moreover, the pressure force may be changed relative to each printing of yellow, magenta and cyan. Further, the pressure force of the thermal head may be consecutively changed instead of changing it stepwise.

Meanwhile, in the forgoing embodiment, the width of the recording paper is measured by the photosensor during the conveyance thereof. However, the width of the recording paper may be identified at the time of setting the recording-paper roll. In another way, a sensor may be provided in a recording-paper containing chamber and a magazine for containing the recording-paper roll. By the way, the color thermal printer is described as an example. The present invention, however, is applicable to the other thermal printers of different recording systems, which are a heat-transfer type, a heat-sublimate type and so forth.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A thermal printer for printing an image on a recording paper, said thermal printer comprising:

a platen for supporting said recording paper;

a thermal head being movable between a thermal-recording position to be pressed toward said platen, and an evacuation position separated from said platen, said thermal head printing the image on the recording paper interposed between the thermal head and the platen when located at the thermal-recording position; and a head-pressing mechanism for moving said thermal head between the thermal-recording position and the evacuation position, said head-pressing mechanism changing a pressure force of said thermal head in accordance with a width of the recording paper in the thermal-recording position, wherein said thermal head extends in a scanning direction corresponding to a width direction of said recording paper; said recording pacer moves in a feed direction perpendicular to the scanning direction while the image is printed; and said head-pressing mechanism changes positions in the scanning direction for pressing said thermal head in accordance with the width of said recording paper.

2. A thermal printer according to claim 1, wherein said head-pressing mechanism comprises:

a plurality of arms attached so as to be coaxial with said thermal head, said arms being arranged in a scanning direction corresponding to a width direction of said recording paper;

a plurality of cam disks for pressing said arms respectively toward the thermal head, each of said cam disks having at least two different radiuses; and a plurality of first springs disposed between the respective arms and the thermal head, said thermal head being pressed when one of the arms is pressed by one of the cam disks toward said thermal head.

3. A thermal printer according to claim 2, wherein said arms include first through fourth arms, the first and fourth arms being positioned at the outside in the width direction, and the second and third arms being positioned at the inside in the width direction.

4. A thermal printer according to claim 3, wherein said cam disks include first through fourth cam disks for pressing said first through fourth arms respectively, the second and third cam disks respectively comprising a smaller-diameter portion, a medium-diameter portion and a larger-diameter portion, and the first and fourth cam disks respectively comprising the smaller-diameter portions and the medium-diameter portion, wherein said smaller-diameter portion sets the thermal head to the evacuation position, the medium-diameter portion presses the thermal head with a first force in the thermal-recording position, and the larger-diameter portion presses the thermal head with a second force stronger than the first force in the thermal-recording position.

5. A thermal printer according to claim 4, wherein said larger-diameter portions of the second and third cam disks abut on the second and third arms respectively to press the thermal head against the recording paper when the recording paper has a first width, and said medium-diameter portions of the first through fourth cam disks abut on the first through fourth arms respectively to press the thermal head against the recording paper when the recording paper has a second width longer than the first width.

6. A thermal printer according to claim 5, further comprising:

a rotary shaft to which the first through fourth cam disks are attached, the respective cam disks being rotated by rotating said rotary shaft;

a gear fixed to an end portion of said rotary shaft; and a motor for rotating said gear and for determining a rotational position of said rotary shaft.

7. A thermal printer according to claim 6, further comprising:

a photosensor for detecting the width of said recording paper, a rotational amount of said motor being controlled in accordance with a detection signal outputted from said photosensor.

8. A thermal printer according to claim 7, further comprising:

a second spring for urging said thermal head toward the evacuation position, an urging force of said second spring being weaker than that of said first spring.

9. A thermal printer for printing an image on a recording paper, which comprises:

a platen for supporting said recording paper;

a thermal head being movable between a thermal-recording position to be pressed toward said platen, and an evacuation position separated from said platen, said thermal head printing the image on the recording paper interposed between the thermal head and the platen when located at the thermal-recording position; and a head-pressing mechanism for moving said thermal head between the thermal-recording position and the evacuation position, said head-pressing mechanism (i) changing a pressure force of said thermal head in accordance with a width or thickness of the recording paper in the thermal-recording position and (ii) comprising (ii-1) a plurality of arms attached so as to be coaxial with said thermal head; (ii-2) a plurality of cam disks for pressing corresponding ones of said arms toward the thermal head; and (ii-3) a plurality of first springs disposed between respective ones of the arms and the thermal head.

10. A thermal printer according to claim 9, wherein each of said cam disks has at least two different diameter portions.

11. A thermal printer according to claim 10, wherein said arms and cam disks are arranged in a direction of the width of said recording paper; at least a first one of said cam disks has a smaller-diameter portion, a medium-diameter portion, and a larger-diameter portion; and at least a second one of said cam disks has a smaller-diameter portion and a medium-diameter portion, wherein said smaller-diameter portions set the thermal head to the evacuation position, said medium-portions press the thermal head with a first force in the thermal-recording position, and the larger-diameter portions press the thermal head with a second force stronger than the first force in the thermal-recording position.

12. A thermal printer according to claim 11, wherein said larger-diameter portion of the first cam disk abuts on its corresponding arm to press the thermal head against the recording paper when the recording paper has a first width, and said medium-diameter portions of the first and second cam disks abut on their corresponding arms to press the thermal head against the recording paper when the recording paper has a second width, said second width being greater than the first width.

13. A thermal printer according to claim 9, further comprising:

a rotary shaft to which the cam disks are attached for rotation therewith;

a gear fixed to an end portion of said rotary shaft; and a motor for rotating said gear and for determining a rotational position of said rotary shaft.

14. A thermal printer according to claim 13, further comprising:

a photosensor for detecting the width of said recording paper, a rotational amount of said motor being controlled in accordance with a detection signal outputted from said photosensor.

15. A thermal printer according to claim 14, further comprising:

a second spring for urging the thermal head toward the evacuation position, an urging force of said second spring being weaker than that of said first springs.

* * * * *